US005514456A

United States Patent [19]

Lefferts

[11] Patent Number: 5,514,456

[45] Date of Patent: May 7, 1996

[54] SPIRAL LINK BELT WITH LOW PERMEABILITY TO AIR AND METHOD FOR ITS PRODUCTION

[75] Inventor: Johannes Lefferts, Enschede, Netherlands

[73] Assignee: SITEG Siebtechnik GmbH, Ahaus-Alstatte, Germany

[21] Appl. No.: 383,433

[22] Filed: Feb. 3, 1995

[30] Foreign Application Priority Data

Feb. 4, 1994 [DE] Germany ..... 44 03 501.2

[51] Int. Cl.[6] ..... D03D 13/00

[52] U.S. Cl. ..... 428/222; 139/383 A; 139/383 AA; 162/358.2; 162/900; 162/902; 428/223

[58] Field of Search ..... 139/383 A, 383 AA; 162/900, 902, 358.2; 428/222, 223

[56] References Cited

U.S. PATENT DOCUMENTS

| | | | |
|---|---|---|---|
| 4,362,776 | 12/1982 | Lefferts et al. . | |
| 4,381,612 | 5/1983 | Shank . | |
| 4,500,590 | 2/1985 | Smith | 428/222 |
| 4,520,065 | 5/1985 | Leo | 428/222 |
| 4,564,992 | 1/1986 | Lefferts . | |
| 5,217,577 | 6/1993 | Steiner | 428/222 |
| 5,334,440 | 8/1994 | Halterbeck et al. | 428/222 |

FOREIGN PATENT DOCUMENTS

| | | |
|---|---|---|
| 0128496 | 12/1984 | European Pat. Off. . |
| 1018419 | 1/1966 | United Kingdom . |
| 2216914 | 10/1989 | United Kingdom . |

*Primary Examiner*—James J. Bell
*Attorney, Agent, or Firm*—Sughrue, Mion, Zinn, Macpeak & Seas

[57] ABSTRACT

A spiral link belt has a plurality of plastic helices connected to one another which interlock in the manner of a slide fastener with neighboring helices. Overlapping widening arcs form a channel and pintle wires run through the channels and thereby connect the helices. Flat wires are inserted in the helices to reduce the air permeability of the spiral link belt. The flat wires are tilted relative to the plane of the spiral link belt. The flat wire running inside a helix can be wider than the smallest distance between the two helices connected to this helix. During production, the spiral link belt is thermoset only after the insertion of the flat wires.

10 Claims, 2 Drawing Sheets

SPIRAL LINK BELT WITH LOW PERMEABILITY TO AIR AND METHOD FOR ITS PRODUCTION

BACKGROUND OF THE INVENTION

The invention relates to a spiral link belt with a plurality of helices connected to one another, whereby the windings of neighboring helices are fitted into one another in the manner of a slide fastener, with the result that the overlapping winding zones form a channel. Pintle wires run in the channels, with the result that the helices cannot be separated. To reduce the permeability of the spiral link belt to air, flat wires are inserted as filling material into the free space of the helices. The invention also relates to a method for the production of such a spiral link belt.

Such spiral link belts are used in particular in the drier section of high-speed paper machines. To achieve a low permeability to air, it is necessary to fill the free inside space of the helices with filling material. If the permeability to air is too great, the spiral link belt creates a very strong turbulent air flow which can lead to uneven running and even to the breakage of the paper web. Spiral link belts currently in use still have a permeability to air of at least 2280 $m^3/m^2/hr/100$ Pa (CFM 140). This is too high for many applications.

Spiral link belts in which the free space inside the helices is filled with filling material in order to reduce the permeability to air are disclosed in U.S. Pat. No. 4,362,776 and U.S. Pat. No. 4,564,992. The filling material can consist, inter alia, of a strip of yarn or of a flat strip.

A spiral link belt with flat wires as filling material is disclosed in U.S. Pat. No. 4,381,612. Instead of a single flat wire, two filling threads can also be inserted into the free space of every helix.

Also disclosed is a version in which filling wires made from material with a low melting point, e.g. nylon or polypropylene, are used. Upon thermosetting, these filling wires then melt and close the open meshes of the spiral link belt.

Spiral link belts are produced by fitting the helices into one another first and then inserting pintle wires into the channels which the overlapping windings of neighboring helices form. If a spiral link belt with as low as possible permeability to air is to be produced, filling wires are subsequently inserted into the free inside space of the helices. When flat wires are used as filling wires, precautions must be taken to ensure that the flat wires do not become twisted. If several round wires are inserted as filling material into the inside space of every helix, it must be ensured that the round wires do not lie above one another. The result of a twisting of the flat wires or of a superimposition of the round wires is that the monoplanar character of the finished spiral link belt is destroyed, which can lead to markings in the paper web. This problem is usually countered by pre-setting the spiral link belt before the insertion of the filling wires and, in so doing, flattening the originally slightly oval cross-section shape of the helices by means of heat and pressure to the extent that the flat wires and the several round wires can no longer become twisted or superimposed on one another. After the insertion of the filling wires, the spiral link belt then undergoes final thermosetting. The pre-setting is thus an additional work step which causes substantial costs.

With the known spiral link belts, the filling wires also lie relatively loosely in the inside of the helices. It is true that the edges of a spiral link belt are glued, whereby the lateral openings of the helices are closed, with the result that the filling wires cannot slip out sideways. However, the edges of a spiral link belt are often damaged while running in the paper machine and the filling wires pulled out.

SUMMARY OF THE INVENTION

The object of the invention is therefore to create a spiral link belt which has a low permeability to air for a small production cost.

According to the invention, this object is achieved in that the flat wires which are located as filling material in the inside of the helices are tilted relative to the plane of the spiral link belt.

The tilt of the flat wires means that the longer cross-section axis of the flat wires lies at an angle to the longer cross-section axis of the helices which lies in the plane of the spiral link belt. The angle of tilt can be e.g. 15°–25° and preferably ca. 20°. A prerequisite for this is naturally that the flat wire itself lies in one plane and is not twisted.

The angle of tilt is preferably so great that one edge of the flat wire lies above the plane of the highest points of the pintle wires, while the other edge lies beneath the plane of the lowest points of the pintle wires.

Normally, all the flat wires are tilted in the same direction. However, the angle of tilt can also be alternately positive and negative, with the result that the flat wires, seen in axial direction of the helices, fall and rise alternately from left to right.

As a result of the tilting of the flat wires, use is made of the diagonal inside the free space of the helices and there is the possibility of choosing wider flat wires, as a result of which the permeability to air of the spiral link belt is reduced. The flat wires running inside the helices are preferably wider than the smallest distance between the two neighboring helices connected to a given helix. The term "diagonal" refers to the imaginary rectangle which is formed by the intersection points, two in each case and thus four in all, of a helix with the preceding and the following helix. As a result of the greater width of the flat wires, these can no longer become twisted inside the helix.

Normally, only a single flat wire is found in the inside of every helix. However, there is also the possibility of inserting into a helix two flat wires of particularly small thickness, superimposed one on the other. Each of these two particularly thin flat wires is then however wider than the smallest distance between the two neighboring helices connected to the helix in question, as previously described.

For a spiral link belt to have as low a permeability as possible to air, it is not enough that it is substantially closed in plan view by filling material, e.g. flat wires. There must also be no larger, three-dimensionally looped routes for the passage of air through the spiral link belt. Space for such a three-dimensionally looped path exists in particular between the tips of two neighboring winding arcs of a helix, as these two winding arcs abut on one side of a pintle wire, while the winding arc of the neighboring helix lying between them abuts on the other side of the pintle wire, with the result that a passage aperture exists which is limited laterally by the two winding arcs and to the front and rear by the pintle wire and the flat wire respectively. As this space remains open in the case of conventional spiral link belts with flat wires, the permeability to air cannot be reduced far enough. With the spiral link belt according to the invention, the longitudinal edges of the flat wires are clamped in almost pincer-like manner by the winding arcs and limbs of neighboring helices lying one against the other. The flat wire bumps against the inside of its helix, i.e. of the helix into which it was inserted, and abuts from the outside against the preceding and the following helix, in each case, at points at which its helix touches the preceding and the following helix. No substantial passage apertures thus exist between the winding limbs of a helix, the flat wire lying in it and the winding arcs of the preceding and following helices. On the other side of the winding arcs considered here, the pintle wire and the winding limbs lie similarly close together, with the result that, here too, there are no substantial passage apertures. Overall, a surface saw-toothed or stepping in shape when considered in the axial direction of the helices and which is largely closed, thus runs through the flat wires, the winding limbs and arcs and the pintle wires. With the spiral link belt according to the invention, there are thus no three-dimensionally looped paths of larger cross-section through the spiral link belt, with the result that it has a very low permeability to air.

Another advantage of the spiral link belt is that the flat wires are firmly anchored inside the spiral link belt and thus cannot be torn out of the spiral blink belt even if the edges of the spiral link belt are damaged in the paper machine.

The subject of the invention is also a method for the production of the previously described spiral link belt, whereby the spiral link belt is thermoset only once, namely after the introduction of the flat wires. A pre-setting of the spiral link belt prior to the introduction of the filling wires is no longer necessary. During thermosetting, the spiral link belt is heated and simultaneously stretched in the longitudinal direction, i.e. in the plane of the spiral link belt perpendicular to the pintle wires, and pressed flat. The individual helices are thereby markedly stretched and flattened. The flat wire located in the inside of a helix rotates to the plane of the screen belt, i.e. the angle of tilt becomes smaller, and the two longitudinal edges of the flat wire are clamped in pincer-like manner by the winding limbs of the helix in which it is located and by the winding arcs of the respective preceding and following helices, with the result that the flat wire is firmly anchored in the screen structure and cannot slip out of the helix. Because the angle of tilt becomes smaller, the apparent width of the flat wire increases parallel to the plane of the spiral link belt and the flat wire presses against the two neighboring helices connected to the spiral in question, as a result of which interstices which still exist are filled in.

Another advantage of the method according to the invention is that the pintle wires and the flat wires serving as filling wires can be introduced at the same time.

The spiral link belt can be produced from helices whose cross-section shape is a parallelogram with diagonals of different lengths, whereby the pintle wires inevitably slip into the angles connected by the longer diagonal and the flat wires lie on the shorter diagonal. The corners of the parallelogram are of course rounded. Even wider flat wires can be introduced into helices having this cross-section shape. Upon thermosetting of the spiral link belt after the introduction of the flat wires, the helices then assume the customary flattened cross-section shape. The edges of every flat wire are clamped in pincer-like manner at a greater depth between the winding limbs of the helix concerned and the winding arcs of the preceding or following helix, which makes possible a further reduction in the permeability to air.

The helices can also be triangular, rectangular or quadratic in cross-section or have any other cross-section shape into which particularly wide flat wires can be introduced which are wider than flat wires normally introduced into conventional oval helices.

The helices can be wound from monofilaments having a circular cross-section. To achieve a particularly low permeability to air, it is however generally preferably to wind the helices from monofilaments having a flattened cross-section with a sides ratio of ca. 1:1.3 to 1:3.

The edges of particularly wide flat wires can prevent the winding limbs from laying themselves in one plane at these points during thermosetting, and thus prevent the spiral link belt from having a monoplanar character. This problem can be dealt with by using flat wires with tapered edges. The edges of such flat wires are more flexible because the material thickness is smaller, and thus lay themselves better around the winding limbs and arcs by which they are clamped in pincer-like manner.

The reduction in material thickness preferably begins in the middle zone of the cross-section or the flat wires, with the result that these acquire a flat rhomboid cross-section. The flat wires can also have other cross-section profiles, e.g. the cross-section profile can taper at only on longitudinal edge, while it is cut off straight or rounded at the other longitudinal edge. The cross-section profile can also be rounded at both longitudinal edges.

According to a preferred version of the method according to the invention, flat wires are used which, upon thermosetting, shrink in their longitudinal direction and expand in their transverse direction. In order that the flat wires extend over the whole width of the spiral link belt after the thermosetting, they are preferably introduced with a suitable excess length into the cavities of the helices. Prior to the thermosetting, the flat wires thus project somewhat at the sides of the spiral link belt. Upon thermosetting, they then shrink in their longitudinal direction, with the result that their final length is the same as the width of the spiral link belt. The use of such flat wires results in the advantage that the flat wires fill the cavities of the helices even better as a result of their expansion in the transverse direction.

Flat wires with this property of shrinking in their longitudinal direction and expanding in their transverse direction upon thermosetting are commercially available.

As well as the extremely low permeability to air, there are the aforementioned advantages of the production method, namely the absence of pre-setting, simultaneous introduction of the pintles and flat wires and the firm anchoring of the flat wires in the spiral link belt.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
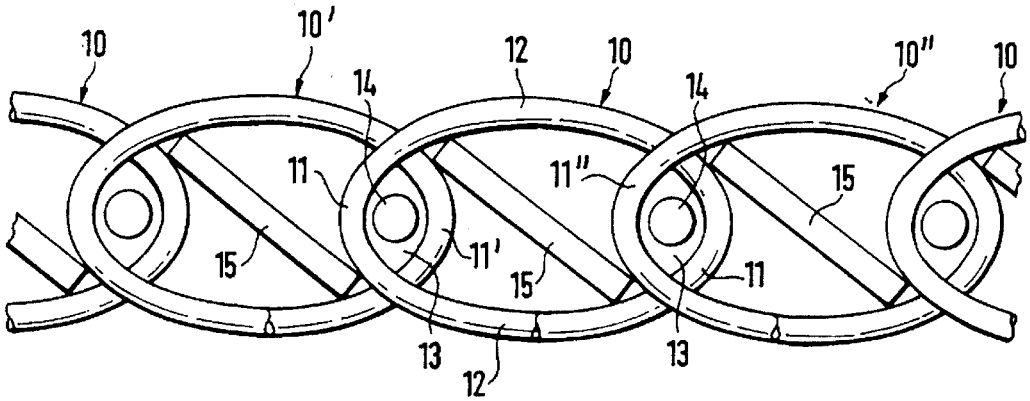
FIG. 1 is a diagrammatic cross-section of a spiral link belt in the longitudinal direction with a flat wire according to a first embodiment of the invention.

FIG. 1 shows a spiral link belt in section in the longitudinal direction. The spiral link belt is composed of a plurality of helices 10 lying parallel next to one another and interlocking with each other, whereby each helix 10 is formed from a plurality of windings with an elliptical cross-section. Each winding is divided into two winding arcs 11 and two slightly curved or flat winding limbs 12. The helices 10 mesh with one another, with the result that the winding arcs 11 of one helix 10 interlock in the manner of a slide fastener with the winding arcs 11' and 11" of the two neighboring helices 10' and 10". The interlocking winding arcs 11, 11' and 11" overlap to the extend that they define channels 13. Inserted into the channels are pintle wires 14 which connect the helices 11, 11' and 11" firmly to one another, with the result that the helices are no longer releasable from their reciprocal engagement. The winding limbs 12 form the top and bottom of the spiral link belt.

Flat wires 15 are located as filling material in the free inside space of the helices 10. The flat wires 15 are tilted relative to the plane of the spiral link belt. As a result, more space is available for the flat wires 15 and wider flat wires 15 can be inserted into the helices 10. The flat wire 15 inside a helix 10 runs roughly in the direction of the diagonal of the rectangle which in FIG. 1 is formed by the intersection points of the two winding acts 11 of this helix 10 with the overlapping winding arcs 11' and 11" respectively of the neighboring helices 10' and 10".

Figure 2:
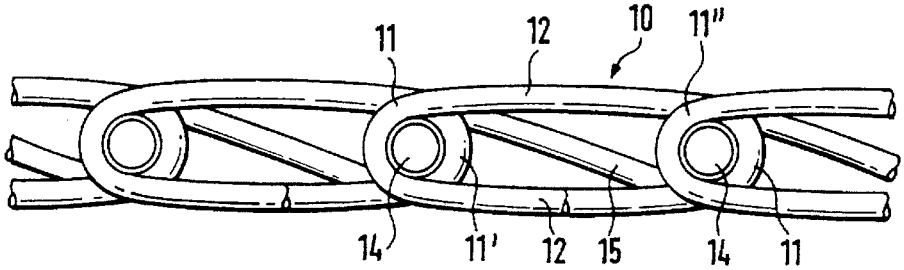
FIG. 2 is a cross-section of the spiral link belt shown in FIG. 1 after thermosetting.

While FIG. 1 shows the spiral link belt prior to thermosetting, with the result that the helices 11 have roughly their original elliptical or oval shape, FIG. 2 shows the spiral link belt after thermosetting. After thermosetting, the individual helices 10 are flattened to the extent that the winding limbs 12 lie virtually in one plane, and therefore form a largely smooth surface of the spiral link belt. Although the angle of tilt of the flat wires 15 is now smaller, it is still large enough for one longitudinal edge of the flat wire 15, in FIG. 1 the left-hand one, to lie above the plane which is defined by the highest points of the pintle wires 14, while the other longitudinal edge of the flat wire 15, in FIG. 1 the right-hand one, lies below the plane which is formed by the lowest points of the pintle wires 14. The width of the flat wires 15 is so chosen that, even after thermosetting, it is greater than the smallest distance between the helices 10' and 10" which are connected to a helix 10. The flat wires 15 are thus clamped at their longitudinal edges in pincer-like manner between the winding arcs 11 of one helix and the interlocking winding arcs 11' and 11" of the preceding and following helices 10', 10" respectively.

Figure 3:
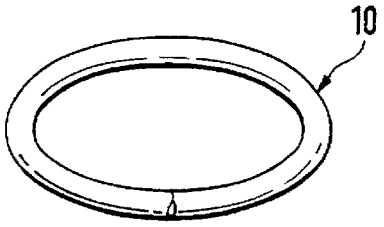
FIG. 3 is a diagrammatic cross-section of the spiral link belt in FIG. 1 showing the shape of a helix thereof.
Figure 4:
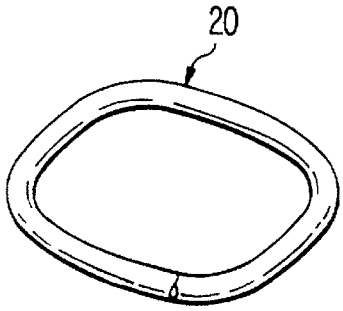
FIG. 4 is a diagrammatic cross-section of a helix having a parallelogram configuration according to a second embodiment.

FIG. 3 shows the oval across-section shape of helices such as used in FIGS. 1 and 2 for the production of spiral link belts, prior to thermosetting. According to a second embodiment of the invention, helices 20 with a parallelogram-shaped cross-section as shown in FIG. 4 are used instead of the oval cross-section shape. The parallelogram has angles of roughly 5020 and 130° and the length ration of the sides of the parallelogram is ca. 1.5 to 2.

Figure 5:
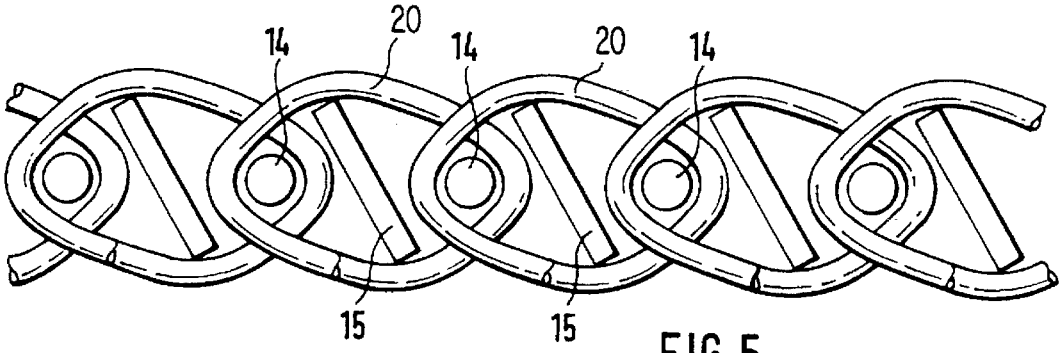
FIG. 5 is a diagrammatic cross-section of a spiral link belt in which the helices have a parallelogram cross-section shape as shown in FIG. 4.

FIG. 5 shows, in longitudinal section, a section of the belt comprising several helices cut out from such a spiral link belt prior to thermosetting. The pintle wires 14 lie in the angles of the parallelogram connected by the longer diagonal, with the result that the position of the helices 20 is stable during thermosetting. The position of each flat wire 15 roughly coincides in the representation of FIG. 5 with the shorter diagonal of the parallelogram. As a result of the use of helices having the special initial parallelogram-like shape shown in FIG. 4, even wider flat wires 15 can be inserted into the helices than with the version of FIG. 1 to 3.

The production method in FIG. 5 is the same compared with the version of FIGS. 1 to 3, and in particular the pintle wires 14 and the flat wires 15 can be inserted into the helices in one work step.

Figure 7:
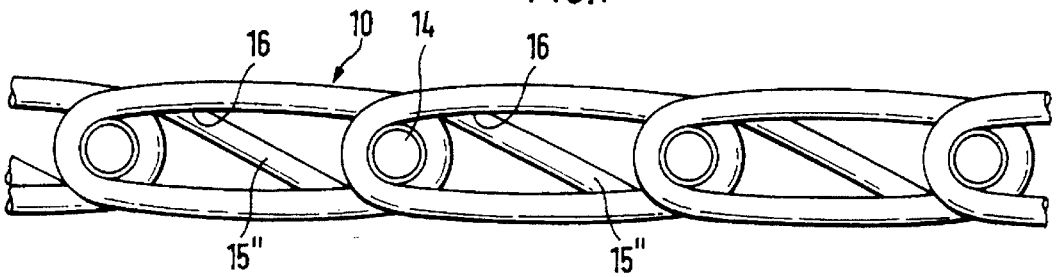
FIG. 7 is a diagrammatic cross-section view of using flat wires with tapered edges.
Figure 6:
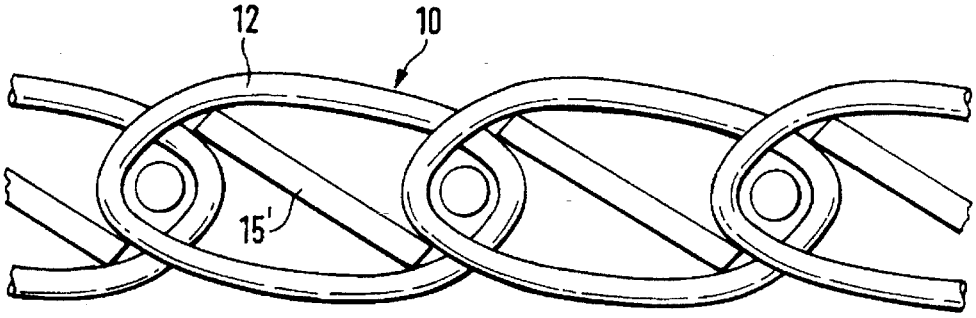
FIG. 6 is a view similar to FIG. 1 showing the unevenness of the spiral belt surface when using a flat wire with bluntly cut-off edges.

When particularly wide flat wires are used, problems can result as regards the monoplanar character of the surface of the finished spiral link belt. The flat wires mentioned thus far have a rectangular cross-section of e.g. 0.5 mm×2.8 mm. As mentioned, the edges of the flat wires 15 are clamped in pincer-like manner between the winding arcs and limbs 11, 12 upon thermosetting. In the case of particularly wide and/or thick flat wires 15', there is the danger that the flat wires 15' cannot be pressed fully downwards by the winding limbs 12, with the result that the winding limbs 12 remain in their original slightly curved shape and, because of this, the surface of the spiral link belt does not become monoplanar, as shown in FIG. 6. In order to also achieve monoplanar surfaces of the spiral link belt with particularly wide flat wires, flat wires 15" with a cross-section profile tapering towards the longitudinal edges are used in the version shown in FIG. 7. In the case of the flat wires 15" shown in FIG. 7, the longitudinal edges are bevelled in such a way that a cut edge 16 parallel to the surface of the spiral link belt results, i.e. the angle of taper is roughly equal to the angle of tilt of the flat wires. The permeability to air is not affected by this, but the monoplanar character of the spiral link belt is guaranteed by it.

Figure 8:
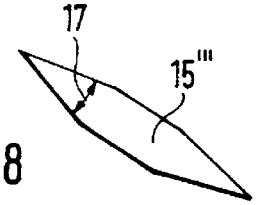
FIG. 8 is a cross-sectional view of a flat wire with the material thickness reducing towards the opposite longitudinal edges to provide tapered edges.

FIG. 8 shows, in section, flat wires 15''' with a cross-section profile which tapers at a particularly acute angle 17, with the result that the cross-section profile is virtually rhomboid.

EXAMPLES

Given below, for three different spiral link belts, are the measurements of the helices, of the pintle wires and of the filling material flat wires, plus the achieved permeability to air. In each case the material was polyester.

TABLE

| | Example 1 | Example 2 | Example 3 |
|---|---|---|---|
| Shape of the helices (mm × mm) | 5.3 × 3.2 | 5.5 × 3.3 | 5.3 × 3.2 |
| Spiral wires (ø mm) | 0.6 | 0.6 | 0.7 × 0.43 |
| Pintle wires (ø mm) | 0.9 | 0.9 | 0.9 |
| Smallest distance between neighbouring helices (mm) | 1.1 | 1.3 | 1.78 |
| Filling material flat wires (mm × mm) | 2.2 × 0.5 | 2.3 × 0.5 | 2.8 × 0.62 |
| Permeability to air (CFM) | 130 | 90 | 50 |

The values given are the measurements prior to thermosetting. The permeability to air was of course measured after thermosetting. The free distance between the neighboring helices is calculated from the longer cross-section measurement of the helices minus 4 times the diameter of the spiral wire minus 2 times the diameter of the pintle wire. In all three cases, this distance is clearly smaller than the longer cross-section measurement of the filling material flat wires. The relationships naturally shift somewhat as a result of the thermosetting. However, even after the thermosetting the flat wires are wider than the just defined distance between the neighboring helices.

While the invention has been particularly shown and described with reference to preferred embodiments thereof, it will be understood by those in the art that the foregoing and other changes in form and details may be made therein without departing from the spirit and scope of the invention.

What is claimed is:

1. A spiral link belt comprising a plurality of plastic helices interconnected in a common plane, each plastic helix having flat winding limbs and interconnecting winding arcs with the winding arcs of a helix disposed in intermeshing engagement with winding arcs of a preceding helix and a following helix to define channels, so that a distance is defined between the winding arcs of the preceding and the following helices, the winding limbs of one helix and the winding arcs of said preceding and following helices defining a free space within said one helix, a pintle wire disposed in each channel to connect the helices and a flat wire extending through said free space within each helix to reduce the air permeability of the spiral link belt wherein the flat wires are tilted relative to the plane of the spiral link belt.

2. A spiral link belt according to claim 1, wherein the flat wire inside a helix is wider than the distance between two adjacent helices connected at opposite sides thereof.

3. A spiral link belt according to claim 1, wherein the flat wire inside a helix extends below a pintle wire at one side of a helix and above a pintle wire at an opposite side of said helix.

4. A spiral link belt according to claim 1, wherein the flat wire inside a helix is clamped between an inside surface of the helix in which the flat wire is disposed and an outside surface of an adjacent helix.

5. A spiral link belt according to claim 1, wherein each of the flat wires is tapered to an acute angle along opposite longitudinal edges thereof.

6. A spiral link belt according to claim 5, wherein the acute angle is smaller than an angle of tilt of each flat wire relative to the plane of the spiral link belt.

7. A method for the production of a spiral link belt comprised of a plurality of plastic helices comprising meshing the helices into one another to form a plurality of channels, inserting a pintle wire into each channel, inserting a flat wire into each helix, thermosetting the spiral link belt only after insertion of the flat wires.

8. A method according to claim 7, wherein each helix has a cross-sectional shape in the form of a parallelogram with a first diagonal of a longer length and a second diagonal of a shorter length whereby said pintle wires are disposed in angles of the parallelogram connected by the first longer diagonal and the flat wires are disposed on the second shorter diagonal.

9. A method according to claim 7, wherein the flat wires upon thermosetting shrink in the longitudinal direction thereof and expand in the transverse direction thereof.

10. A method according to claim 9, wherein the flat wires inserted into the helices have a length greater than a width of the spiral belt whereby upon thermosetting the flat wires shrink to a length corresponding to the width of the spiral link belt.

* * * * *